US005577361A

United States Patent [19]

Grabek, Jr.

[11] Patent Number: 5,577,361

[45] Date of Patent: Nov. 26, 1996

[54] ROOFING SHINGLE

[76] Inventor: Joseph F. Grabek, Jr., Road 1 Box 472, Jeffersonville, N.Y. 12748

[21] Appl. No.: 585,942

[22] Filed: Jan. 16, 1996

[51] Int. Cl.[6] ..... E04D 1/34

[52] U.S. Cl. ..... 52/543; 52/549; 52/553

[58] Field of Search ..... 52/526, 543, 548, 52/549, 551, 552, 553, 554, 555, 557

[56] References Cited

U.S. PATENT DOCUMENTS

| | | | |
|---|---|---|---|
| 3,054,222 | 9/1962 | Buckner | 52/543 |
| 3,082,577 | 3/1963 | Fasold et al. | 52/543 |
| 3,231,453 | 1/1966 | Smith | 52/543 X |
| 3,377,762 | 4/1968 | Chalmers et al. | 52/555 |
| 3,468,092 | 9/1969 | Chalmers | 52/555 X |
| 4,301,633 | 11/1981 | Neumann | 52/543 X |
| 4,333,279 | 6/1982 | Corbine . | |
| 4,825,616 | 5/1989 | Bondac et al. . | |
| 5,037,685 | 8/1991 | Richards et al. | 52/549 X |
| 5,186,980 | 2/1993 | Kioschitzky . | |
| 5,195,290 | 3/1993 | Harlett . | |
| 5,239,802 | 8/1993 | Robinson | 52/553 X |
| 5,287,669 | 2/1994 | Hannah et al. . | |

FOREIGN PATENT DOCUMENTS

| | | | |
|---|---|---|---|
| 963626 | 3/1975 | Canada | 52/553 |

*Primary Examiner*—Lanna Mai

[57] ABSTRACT

A roofing shingle including a weather resistant strip that has an exterior side and an interior side. The weather resistant strip has a top portion and a plurality of tabs that are divided by a plurality of slots. Each tab extends longitudinally between at least two slots. Included is an elongated metallic strip. The metallic strip has a face side and an underside that is attached to the exterior side of the weather resistant strip. The metallic strip is attached between the top portion and above each slot. Lastly, an elongated tar strip is attached to the face side of the metallic strip.

4 Claims, 3 Drawing Sheets

FIG 1
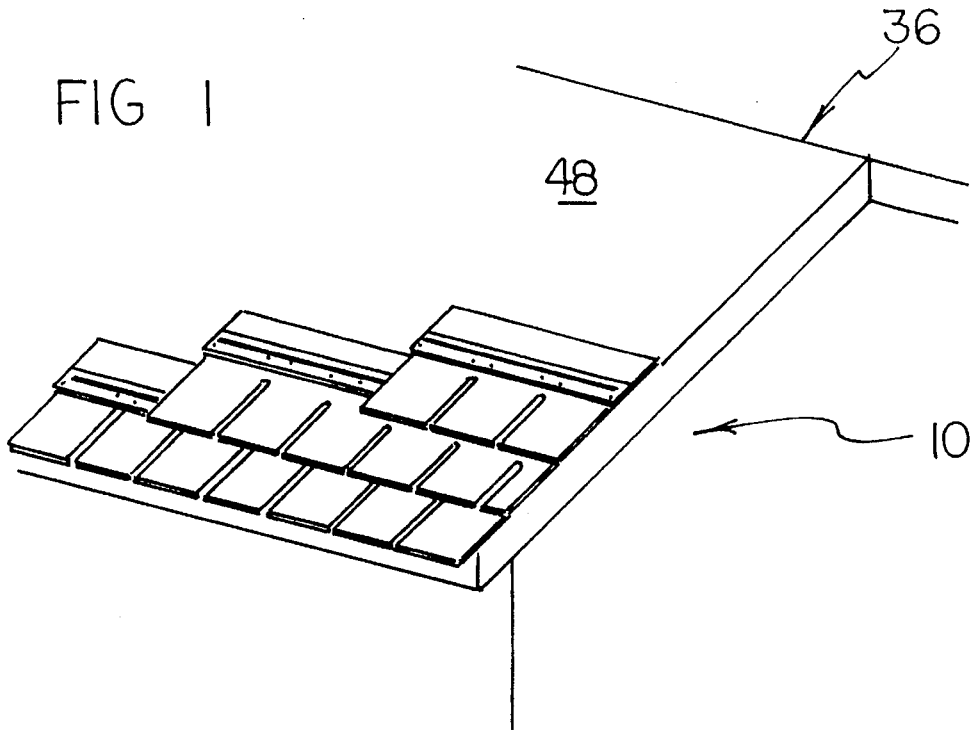
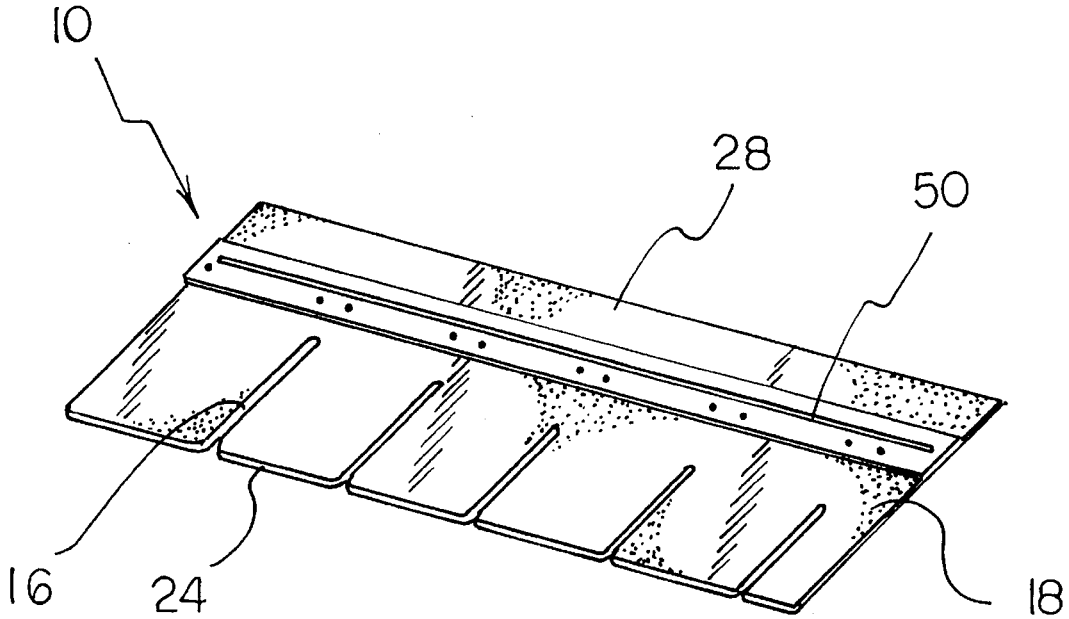
FIG 2

ROOFING SHINGLE

BACKGROUND OF THE INVENTION

1. Field of the Invention

The present invention relates to a roofing shingle and more particularly pertains to providing a reinforcement strip for retaining the shingle during high wind conditions, and further providing the reinforcement strip with a mechanism for attaching to the overlapping shingle.

2. Description of the Prior Art

The use of roofing shingles is known in the prior art. More specifically, roofing shingles heretofore devised and utilized for the purpose of shingling a rood are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,287,669 to Hannah, Mehrer, Noone, Stahl and Quaranta discloses a roofing shingle. U.S. Pat. No. 5,195,290 to Hulett discloses a laminar roofing product. U.S. Pat. No. 5,186,980 to Kioschitzky discloses roofing shingles and method of making same. U.S. Pat. No. 5,037,685 to Richards and Richards discloses a vinyl shingle roofing product. U.S. Pat. No. 4,825,616 to Bondoc, Frankoski and Sieling discloses a roofing shingle. Lastly, U.S. Pat. No. 4,333,279 to Corbine and Reinhart discloses a three-tab shingle with staggered butt edge feature.

While these devices fulfill their respective, particular objectives and requirements, the aforementioned patents do not describe roofing shingle that allows reduction in the amount of damage received to roof shingles during the passing of a storm that produces high winds.

In this respect, the roofing shingle according to the present invention substantially departs from the conventional concepts and designs of the prior art, and in doing so provides an apparatus primarily developed for the purpose of providing a reinforcement strip for retaining the shingle during high wind conditions, and further providing the reinforcement strip with a mechanism for attaching to the overlapping shingle.

Therefore, it can be appreciated that there exists a continuing need for a new and improved roofing shingle which can be used for providing a reinforcement strip for retaining the shingle during high wind conditions, and further providing the reinforcement strip with a mechanism for attaching to the overlapping shingle. In this regard, the present invention substantially fulfills this need.

SUMMARY OF THE INVENTION

In view of the foregoing disadvantages inherent in the known types of roofing shingles now present in the prior art, the present invention provides an improved roofing shingle. As such, the general purpose of the present invention, which will be described subsequently in greater detail, is to provide a new and improved roofing shingle and method which has all the advantages of the prior art and none of the disadvantages.

To attain this, the present invention essentially comprises an elongated strip of weather resistant material. The elongated strip has an exterior side and an interior side. The exterior side of the elongated is formed of an asphalt material with granules embedded therein. The elongated strip has a length of between 36 to 39 9/16 inches. The elongated strip has a width between 1½ to 1¼ inches. The elongated strip has a plurality of tabs that are divided by a plurality of slots and a top portion. Each tab extends longitudinally between at least two slots. Each tab has substantially equal lengths and widths with one tab having a width half the width of the other tabs. Each slot extends from an edge of each tab to terminate a predetermined distance from the edge. Included is an elongated metallic strip that has a face side and an underside. The underside of the metallic strip is attached to the exterior side of the elongated strip between the top portion and above a termination point of each slot. The face side of the metallic strip has a plurality of circular indentations longitudinally aligned. The indentations are proportionately spaced along the length of the metallic strip. The indentations are capable of allowing a nail to pierce the metallic strip for fastening the elongated strip to a roof surface. The metallic strip has a length equal to the length of the elongated strip. The metallic strip is 20 gauge and has a width between about 1¼ to 1½ inches. Lastly, an elongated tar strip is attached to the face side of the metallic strip. The tar strip allows the tab of the elongated strip that is partially overlapped to attach. The overlap elongated strip attaches when the strip is in an installed condition.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roofing shingle which has all of the advantages of the prior art roofing shingles and none of the disadvantages.

It is another object of the present invention to provide a new and improved roofing shingle which may be easily and efficiently manufactured and marketed.

It is further object of the present invention to provide a new and improved roofing shingle which is of durable and reliable constructions.

An even further object of the present invention is to provide a new and improved roofing shingle which is susceptible of a low cost of manufacture with regard to both materials and labor, and which accordingly is then susceptible of low prices of sale to the consuming public, thereby making such roofing shingle economically available to the buying public.

Still yet another object of the present invention is to provide a new and improved roofing shingle which provides in the apparatuses and methods of the prior art some of the advantages thereof, while simultaneously overcoming some of the disadvantages normally associated therewith.

Even still another object of the present invention is to provide a roofing shingle for providing a reinforcement strip for retaining the shingle during high wind conditions, and further providing the reinforcement strip with a mechanism for attaching to the overlapping shingle.

Lastly, it is an object of the present invention to provide a new and improved roofing shingle including a weather resistant strip that has an exterior side and an interior side. The weather resistant strip has a top portion and a plurality of tabs that are divided by a plurality of slots. Each tab extends longitudinally between at least two slots. Included is an elongated metallic strip. The metallic strip has a face side and an underside that is attached to the exterior side of the weather resistant strip. The metallic strip is attached between the top portion and above each slot. Lastly, an elongated tar strip is attached to the face side of the metallic strip.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the roofing shingle constructed in accordance with the principles of the present invention.

FIG. 2 is an elevational isometric view of the present invention.

The same reference numerals refer to the same parts through the various Figures.

DESCRIPTION OF THE PREFERRED EMBODIMENT

Figure 3:
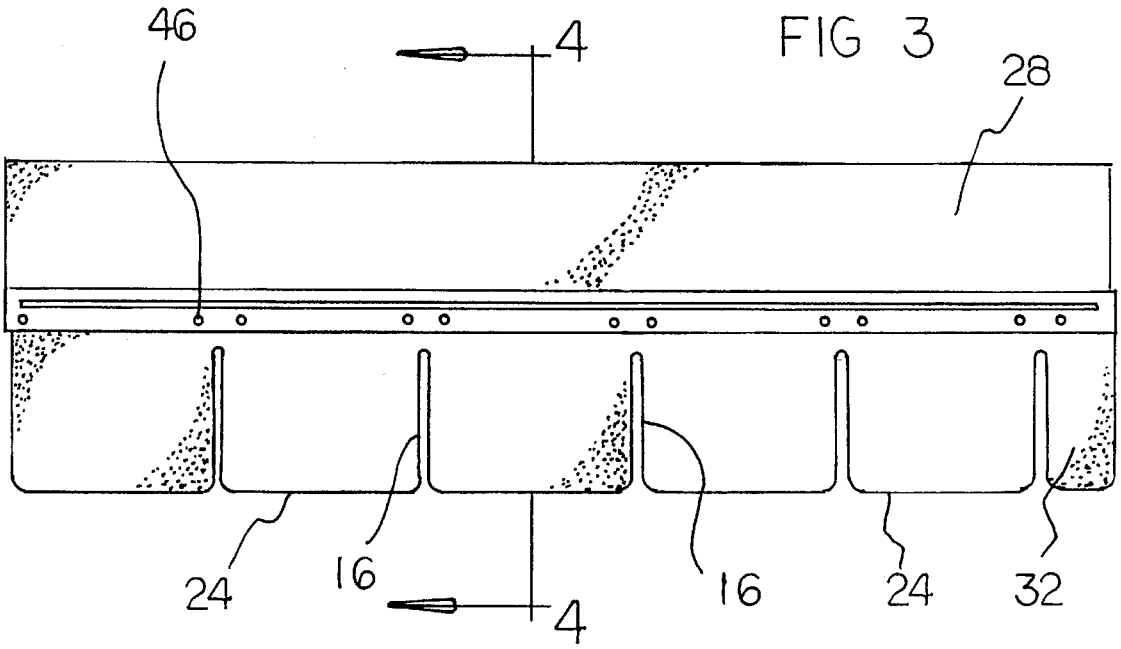
FIG. 3 is a top plan view of the present invention of FIG. 1.

With reference now to the drawings, and in particular to FIG. 1 thereof, the preferred embodiment of the new and improved roofing shingle embodying the principles and concepts of the present invention and generally designated by the reference numeral 10 will be described.

The present invention, the roofing shingle 10 is comprised of a plurality of components. Such components in their broadest context include a strip, a metal strip and a tar strip. Such components are individually configured and correlated with respect to each other so as to attain the desired objective.

Figure 4:
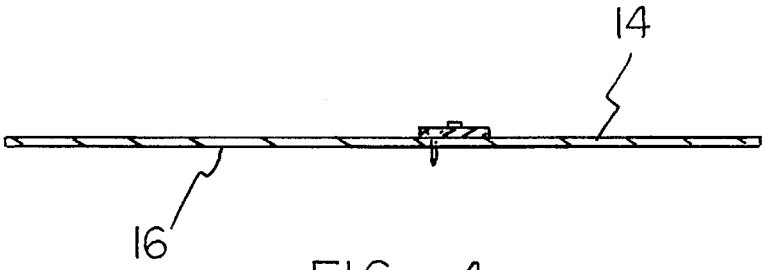
FIG. 4 is a cross sectional side view of the shingles taken along line 4—4 of FIG. 3.

Specifically, the present invention includes an elongated strip 12 of weather resistant material. As illustrated in FIG. 4, the elongated strip has an exterior side 14 and an interior side 16. The exterior side of the elongated strip is formed of an asphalt material with granules 18 embedded, as seen in FIG. 2. The interior side is formed of the tar paper or any commercially available mat material currently in use. The elongated strip has a length of between 36 to 39 9/16 inches. The elongated strip has a width between 1½ to 1¼ inches.

Figure 5:
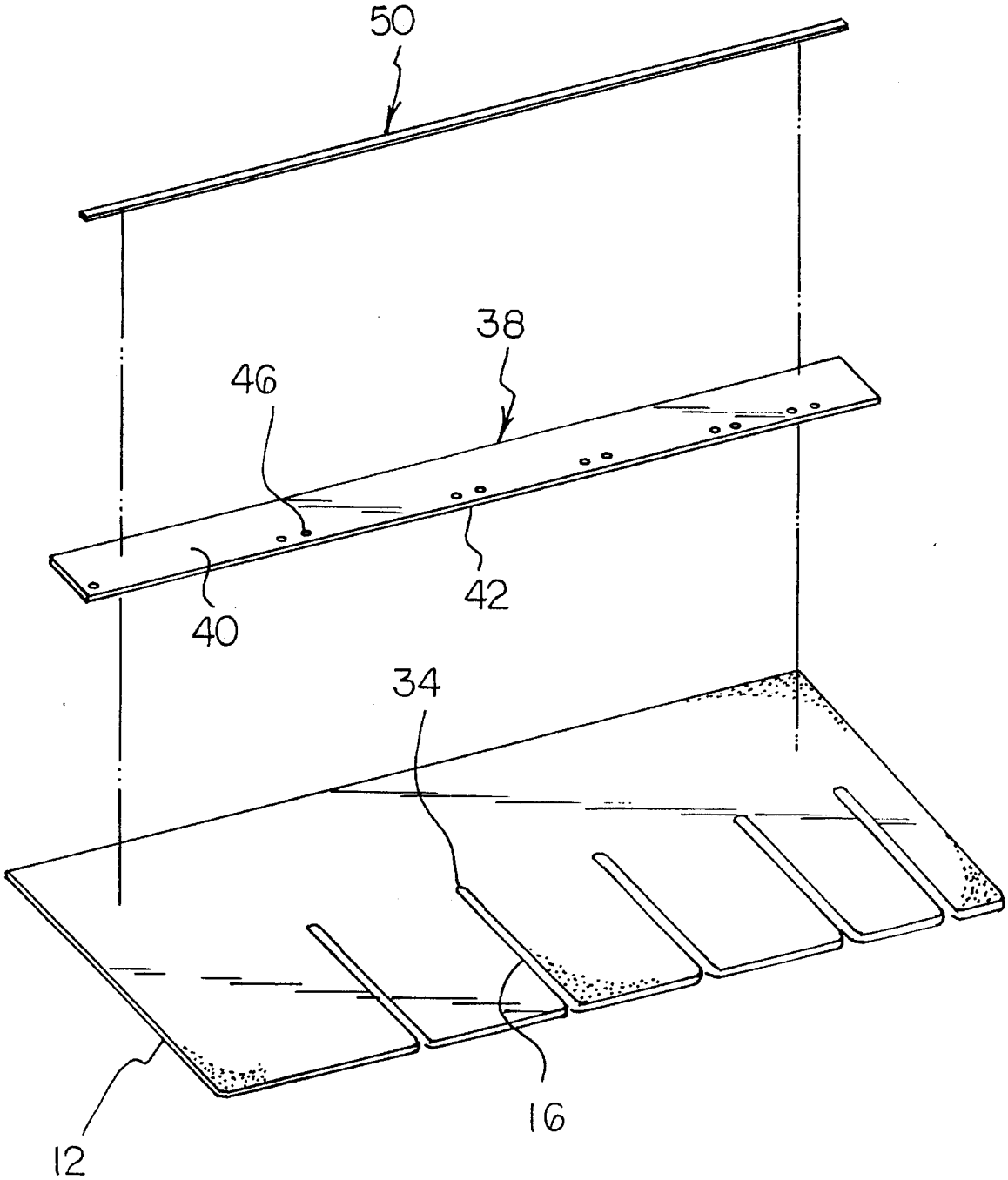
FIG. 5 is an exploded view of the operable components of the present invention of FIG. 1.

The elongated strip 12 has a plurality of tabs 24 that are divided by a plurality of slots 16. Also, the elongated strips, as shown in FIG. 3, has a top portion 28. Each tab extends longitudinally between at least two slots. Each tab has substantially lengths and widths with one tab 32 having a width about half the width of the other tabs 24. As best seen in FIG. 5, each slot extends from an edge of each tab and terminates a predetermined distance from the edge at point 34. The strip is structure to provide shingling for a roof 36 as shown in FIG. 1. A plurality of elongated strips are attached to the roof, whereby after one row is completed another row is attached. The next row partially overlaps the preceding row, covering the top portion of the elongated strip and leaving the tabs exposed.

Also, an elongated metallic strip 38 is provided. The elongated metallic strip is generally rectangular and has a planar configuration. The metallic strip has a face side 40 and an underside 42. The underside of the metallic strip is attached to the exterior side 14 of the elongated strip 12. The metallic strip may be attached to the elongated strip during the heat sealing process that attaches the asphalt and granules. Additionally, the metallic strip may be embedded within the matting material of the elongated strip. The metallic strip is attached between the top portion 28 and above a termination point 34 of each slot, as shown in FIG. 3.

The face side 40 of the metallic strip has a plurality of circular indentations 46 that are longitudinally aligned. The indentations are proportionately spaced along the length of the metallic strip. The metallic strip, at the position of the indentations, is about 15 gauge, and allows a nail to pierce the metallic strip for fastening of the elongated strip to a roof surface 48. The metallic strip has a length equal to the length of the elongated strip. The metallic strip is about 20 gauge and has a width between about 1¼ to 1½ inches. Preferably, the metallic strip is made from a coated aluminum.

Lastly, an elongated tar strip 50 is attached to the face side 40 of the metallic strip 38. The tar strip has a length equal to the length of the metallic strip. The width of the tar strip is about ½ to ¼ inch. The tar strip is capable of allowing the tabs of the elongated strip to attach when they partially overlap a preceding elongated strip. The elongated strips overlap when the elongated strip is in an installed condition.

The present invention is a newly structured roofing shingle that reinforces the elongated strip of the shingle. The present roofing shingles are manufactured with a metallic strip placed on the top portion just above the termination point of the slots of the strip. The roof shingles of the present invention are formed in shapes and sizes that are currently available in the market. The metallic strip that is added to the elongated strip of the roofing shingle increases the shingles life and durability. The shingles of the present invention are capable of withstanding high winds that often accompany hurricanes, tornados, and other storms. The metallic strip increases the structural integrity of the roof shingle along its weakest point, and that is the point above the termination point of the slots. The use of the roofing shingles of the present invention increases the life of the roofing shingles on the roof and reduces the expense to the homeowner or building owner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roofing shingle comprising:

a weather resistant strip having an exterior side and an interior side, the weather resistant strip having a top portion and a plurality of tabs being divided by a plurality of slots, each tab extending longitudinally between at least two slots, each tab having substantially equal length and widths, one tab of said plurality of tabs having a width half the width of the other tabs, each slot extending from an edge of each tab for terminating a predetermined distance from the edge;

an elongated metallic strip having a face side and an underside; said underside being attached to the exterior side of said weather resistant strip, said metallic strip being attached between the top portion and above each slot, said metallic strip having a length equal to the length of said weather resistant strip, said metallic strip being 20 gauge and having a width between about 1¼ to 1½ inches, said face side of said metallic strip having a plurality of circular indentations longitudinally aligned thereon and proportionately spaced along the length thereof, said indentations being capable of allowing a nail to pierce said metallic strip for fastening the elongated strip to a roof surface when the strip being in an installed condition; and an elongated tar strip being attached to the face side of the metallic strip.

2. The roofing shingle as set forth in claim 1 wherein the exterior side of the weather resistant strip being formed of an asphalt material with granules embedded, the weather resistant strip having a length of between 36 to 39$^{9}/_{16}$ inches and a width between 1½ to 1¼ inches.

3. The roofing shingle as set forth in claim 1 wherein the tar strip allowing the tabs of the weather resistant strip partially overlapping to attach thereto.

4. A new and improved roofing shingle for withstanding high winds comprising in combination:

an elongated strip of weather resistant material having an exterior side and an interior side, the exterior side of the elongated strip being formed of an asphalt material with granules embedded therein, the elongated strip having a length of between 36 to 39$^{9}/_{16}$ inches, the elongated strip having a width between 1½ to 1¼ inches;

the elongated strip having a plurality of tabs being divided by a plurality of slots and a top portion, each tab extending longitudinally between at least two slots, each tab having substantially equal lengths and widths with one tab having a width half the width of the other tabs, each slot extending from an edge of each tab for terminating a predetermined distance from the edge;

an elongated metallic strip having a face side and an underside, the underside of the metallic strip being attached to the exterior side of the elongated strip between the top portion and above a termination point of each slot, the face side of the metallic strip having a plurality of circular indentations longitudinally aligned thereon, the indentations being proportionately spaced along the length of the metallic strip, the indentations being capable of allowing a nail to pierce the metallic strip for fastening the elongated strip to a roof surface, the metallic strip having a length equal to the length of the elongated strip, the metallic strip being 20 gauge and having a width between about 1¼ to 1½ inches; and an elongated tar strip being attached to the face side of the metallic strip, the tar strip allowing the tabs of the elongated strip partially overlapping to attach thereto, when the strip being in an installed condition.

* * * * *